US011029047B2

(12) United States Patent
Yuan

(10) Patent No.: US 11,029,047 B2
(45) Date of Patent: Jun. 8, 2021

(54) EVAPORATING ASSEMBLY AND HUMIDIFIER

(71) Applicants: BEIJING XIAOMI MOBILE SOFTWARE CO., LTD., Beijing (CN); BEIJING SMARTMI TECHNOLOGY CO., LTD., Beijing (CN)

(72) Inventor: Ziming Yuan, Beijing (CN)

(73) Assignees: BEIJING XIAOMI MOBILE SOFTWARE CO., LTD., Beijing (CN); BEIJING SMARTMI TECHNOLOGY CO., LTD., Beijing (CN)

( * ) Notice: Subject to any disclaimer, the term of this patent is extended or adjusted under 35 U.S.C. 154(b) by 251 days.

(21) Appl. No.: 16/265,644

(22) Filed: Feb. 1, 2019

(65) Prior Publication Data

US 2019/0242598 A1 Aug. 8, 2019

(30) Foreign Application Priority Data

Feb. 6, 2018 (CN) ..... 201810117540.6

(51) Int. Cl.

| | |
|---|---|
| ***F24F 6/06*** | (2006.01) |
| ***B01F 3/04*** | (2006.01) |
| ***F24F 3/14*** | (2006.01) |

(52) U.S. Cl.

CPC ..... *F24F 6/06* (2013.01); *B01F 3/04028* (2013.01); *F24F 3/14* (2013.01); *F24F 2006/065* (2013.01)

(58) Field of Classification Search

CPC ..... F24F 3/14; F24F 6/06; B01F 3/04; B01F 3/04028

See application file for complete search history.

(56) References Cited

U.S. PATENT DOCUMENTS

| | | | | |
|---|---|---|---|---|
| 638,005 A | | 11/1899 | Chandler et al. | |
| 3,733,062 A | * | 5/1973 | Bracich | F24F 6/06 261/92 |
| 2011/0084415 A1 | | 4/2011 | Kim et al. | |

FOREIGN PATENT DOCUMENTS

| | | |
|---|---|---|
| CN | 2653361 Y | 11/2004 |
| CN | 105526660 A | 4/2016 |
| DE | 101 15 564 A1 | 10/2002 |
| EP | 3 023 704 A1 | 5/2016 |

(Continued)

OTHER PUBLICATIONS

Extended European Search Report dated Jun. 6, 2019, in Patent Application No. 19155465.8, 9 pages.

(Continued)

*Primary Examiner* — Robert A Hopkins

(74) *Attorney, Agent, or Firm* — Oblon, McClelland, Maier & Neustadt, L.L.P.

(57) ABSTRACT

The disclosure relates to an evaporating assembly and a humidifier. The evaporating assembly includes a fixing shaft and at least two evaporating bodies. Each of the evaporating bodies is provided with a mounting hole and at least one group of limiting portions, wherein each of the evaporating bodies is detachably mounted on to the fixing shaft via the mounting hole, and the limiting portions on every two of the evaporating bodies that are adjacent to each other are abuttingly mated so that a first gap is formed between every two of the adjacent evaporating bodies.

11 Claims, 4 Drawing Sheets

(56) References Cited

FOREIGN PATENT DOCUMENTS

| | | | |
|---|---|---|---|
| JP | 60-176037 | U | 11/1985 |
| KR | 10-2010-0038660 | A | 4/2010 |
| KR | 10-2017-0051244 | A | 5/2017 |

OTHER PUBLICATIONS

Combined Chinese Office Action and Search Report dated Nov. 1, 2019 in corresponding Chinese Patent Application No. 201810117540.6 (with English Translation and English Translation of Category of Cited Documents), 13 pages.
Chinese Office Action dated Jun. 19, 2020 in Patent Application No. 201810117540.6 (with English machine translation), 12 pages.
Office Action dated Dec. 15, 2020, in European Patent Application No. 19 155 465.8, 4 pages.

* cited by examiner

EVAPORATING ASSEMBLY AND HUMIDIFIER

CROSS REFERENCE TO RELATED APPLICATIONS

This application is based on and claims priority to Chinese Patent Application No. 201810117540.6, filed on Feb. 6, 2018, the entire contents of which are incorporated herein by reference.

TECHNICAL FIELD

The present disclosure relates to electrical appliances, and more particularly to an evaporating assembly and a humidifier.

BACKGROUND

A user may use a humidifier to increase moisture content in the air, so as to increase air humidity. For example, an evaporative humidifier may achieve the purpose of humidification by evaporating water in the humidifier.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

Aspects of the disclosure provide an evaporating assembly. The evaporating assembly includes a fixing shaft; and at least two evaporating bodies, each of the evaporating bodies is provided with a mounting hole and at least one group of limiting portions, wherein each of the evaporating bodies is detachably mounted on to the fixing shaft via the mounting hole, and the limiting portions on every two of the evaporating bodies that are adjacent to each other are abuttingly mated so that a first gap is formed between every two of the adjacent evaporating bodies.

According to an aspect, at least one of the evaporating bodies includes a plurality of groups of protrusions that are arranged in a radial direction from the mounting hole on the at least one of the evaporating bodies.

According to another aspect, the at least one of the evaporating bodies is in a form of a sheet structure and includes a first side surface and a second side surface that are opposite to each other, and the plurality of groups of protrusions are arranged on at least one of the first side surface and the second side surface.

According to yet another aspect, each group of the plurality of groups of protrusions includes a plurality of strip structures arranged discontinuously.

According to yet another aspect, a first distance that each of the limiting portions protrudes out of the evaporating body is greater than a second distance that each of the protrusions protrudes out of the evaporating body.

According to yet another aspect, at least one of the evaporating bodies includes a protruding texture structure that is arranged on the at least one of the evaporating bodies.

According to yet another aspect, the plurality of groups of protrusions that are arranged on the first side surface or the second side surface divide the first side surface or the second side surface into a plurality of sector regions, and the protruding texture structure is arranged in at least one of the sector regions.

According to yet another aspect, the protruding texture structure includes hexagonal structures arranged in an array.

According to yet another aspect, the mounting hole is a polygonal through hole, and the fixing shaft is a prism with a sectional shape corresponding to a shape of the polygonal through hole.

According to yet another aspect, at least one of the limiting portions includes at least one group of abutting ribs, and each group of the at least one group of abutting ribs is arranged uniformly along a circumference concentric to the mounting hole.

According to yet another aspect, the mounting hole is a polygonal through hole, and a number of sides of the polygonal through hole corresponds to a number of abutting ribs in one group of the at least one group of abutting ribs.

Aspects of the disclosure also provide a humidifier. The humidifier includes a body and an evaporating assembly. The evaporating assembly includes a fixing shaft; a plurality of evaporating bodies mounted on to the fixing shaft, wherein a first gap is formed between every two of the plurality of evaporating bodies that are adjacent to each other; and a mounting hole arranged on each of the plurality of evaporating bodies, wherein each of the plurality of evaporating bodies is detachably mounted on to the fixing shaft through the mounting hole.

It is to be understood that both the foregoing general description and the following detailed description are illustrative and explanatory only and are not restrictive of the present disclosure.

BRIEF DESCRIPTION OF THE DRAWINGS

The accompanying drawings, which are incorporated in and constitute a part of this specification, illustrate aspects consistent with the present disclosure and, together with the description, serve to explain the principles of the present disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

The terminology used in the present disclosure is for the purpose of describing a particular example only, and is not intended to be limiting of the present disclosure. The singular forms such as "a", 'said", and "the" used in the present disclosure and the appended claims are also intended to include multiple, unless the context clearly indicates otherwise. It is also to be understood that the term "and/or" as used herein refers to any or all possible combinations that include one or more associated listed items.

It is to be understood that although different information may be described using the terms such as first, second, third, etc. in the present disclosure, the information should not be limited to these terms. These terms are used only to distinguish the same type of information from each other. For example, the first information may also be referred to as the second information without departing from the scope of the present disclosure, and similarly, the second information may also be referred to as the first information. Depending on the context, the word "if" as used herein may be interpreted as "when" or "as" or "determining in response to".

An evaporative humidifier usually includes sheet evaporating bodies. A contact area between liquid to be evaporated and air may be increased by gapped mating of a plurality of superimposed evaporating bodies. To maintain a gap between adjacent evaporating bodies, all evaporating bodies in an evaporative humidifier are usually formed integrally, which not only increases manufacturing difficulty of injection moulds, but also causes inconvenience of cleaning of dusts and stains that are liable to stacking between adjacent evaporating bodies.

Figure 1:
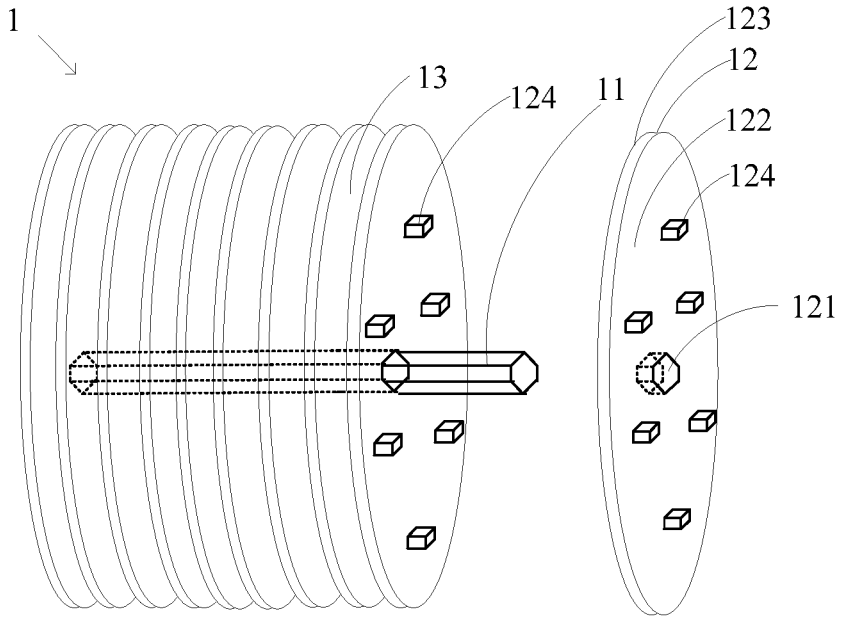
FIG. 1 is a schematic diagram illustrating an exploded structure of an evaporating assembly according to an exemplary aspect of the present disclosure.

FIG. 1 is a schematic diagram illustrating a structure of an evaporating assembly 1 according to an example of the present disclosure. As shown in FIG. 1, the evaporating assembly 1 includes a fixing shaft 11 and at least two evaporating bodies 12. The evaporating body 12 is provided with a mounting hole 121 and at least one group of limiting portions 124. Each group of the limiting portions 124 is located on a side surface that is on the evaporating body 12 and opposite to an adjacent evaporating body 12, and each evaporating body 12 is sleeved on the fixing shaft 11 through the mounting hole 121 so that the evaporating body 12 and the fixing shaft 11 may be detachably connected. The limiting portions 124 on the adjacent evaporating bodies 12 assembled on the fixing shaft 11 are abuttingly mated in such a way that a first gap 13 is formed between the adjacent evaporating bodies 12.

The evaporating body 12 is detachably assembled to (e.g., mounted on to) the fixing shaft 11 through the mounting hole 121. When cleaning is to be performed, a plurality of evaporating bodies 12 may be separated from the fixing shaft 11 individually, thereby facilitating manufacturing, assembly and disassembly as well as cleaning of the evaporating bodies 12. Further, during the use of the above evaporating assembly 1, a plurality of evaporating bodies 12 rotate along with the fixing shaft 11 and the adjacent evaporating bodies 12 roll up liquid to be evaporated through the first gap 13 and the viscosity of the liquid to be evaporated, thereby increasing the contact area between the liquid to be evaporated and air, and effectively improving the evaporating efficiency.

To achieve a detachable connection of the evaporating body 12 and the fixing shaft 11 while effectively guaranteeing assembly stability of the evaporating body 12, the structures of the mounting hole 121 of the evaporating body 12 and the fixing shaft 11 are illustrated in the present disclosure as follows:

The mounting hole 121 may be a polygonal through hole and the fixing shaft 11 may be a prism with a sectional shape corresponding to the shape of the polygonal through hole. A fixing piece (not shown) may also be included to fix both ends of the evaporating bodies 12. When the evaporating body 12 is assembled, the evaporating body 12 may be directly sleeved on the fixing shaft 11 matched with the evaporating body 12 through the mounting hole 121. With mating of the prism and the polygonal through hole, the movement of the evaporating body 12 along a circumferential direction of the prism may be restricted. A plurality of mutually-abutted evaporating bodies 12 may be fixed again with fixing pieces on both ends of the prism. Similarly, when disassembly is performed for cleaning, the evaporating bodies 12 may be directly removed from the prism.

Alternatively, the evaporating body 12 may also be fixed along the circumferential direction of the fixing shaft 11 with another mutually-mating limiting structure of the mounting hole 121 and the fixing shaft 11, which is not limited herein.

The evaporating body 12 may be of sheet structure and may include a first side surface 122 and a second side surface 123 that are opposite to each other. The evaporating body 12 is arranged into sheet structure to facilitate reducing a resistance suffered by the evaporating body 12 when the evaporating body 12 is in contact with the liquid to be evaporated during rotation, thereby effectively lowering power consumption.

Figure 2:
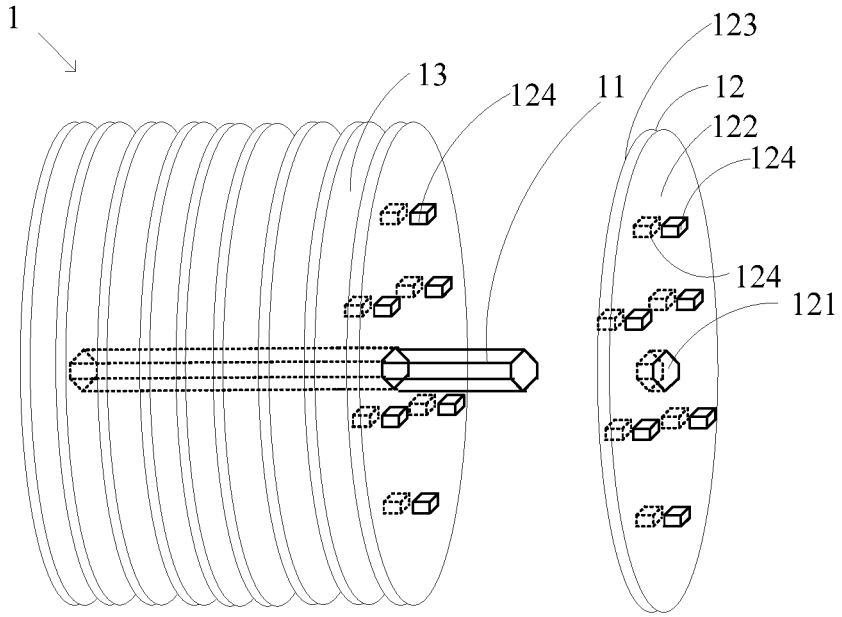
FIG. 2 is a schematic diagram illustrating an exploded structure of an evaporating assembly according to an exemplary aspect of the present disclosure.

As shown in FIG. 1, the limiting portion 124 may include at least one group of abutting ribs arranged on the first side surface 122 or the second side surface 123, and two adjacent evaporating bodies 12 are abuttingly mated through the above abutting ribs. Alternatively, as shown in FIG. 2, the limiting portion 124 may include at least two groups of abutting ribs respectively arranged on the first side surface 122 and the second side surface 123, and each group of the abutting ribs are arranged uniformly along a circumference concentric to the polygonal through hole 121. The number of the sides of the polygonal through hole 121 corresponds to the number of the abutting ribs in one group of abutting ribs. In this way, mating relationship of abutting ribs of adjacent evaporating bodies 12 during assembly may be guaranteed, thereby further avoiding misalignment of positions of abutting ribs of adjacent evaporating bodies caused by change of mating angle of the mounting hole 121 of the evaporating body 12 and the fixing shaft 11 and effectively reducing installation difficulties.

It is noted that each group of limiting portions 124 may also be arranged at any positions of the first side surface 122 or the second side surface 123 as long as the abutting mating of adjacent evaporating bodies 12 may be achieved, which is not limited herein.

Figure 3:
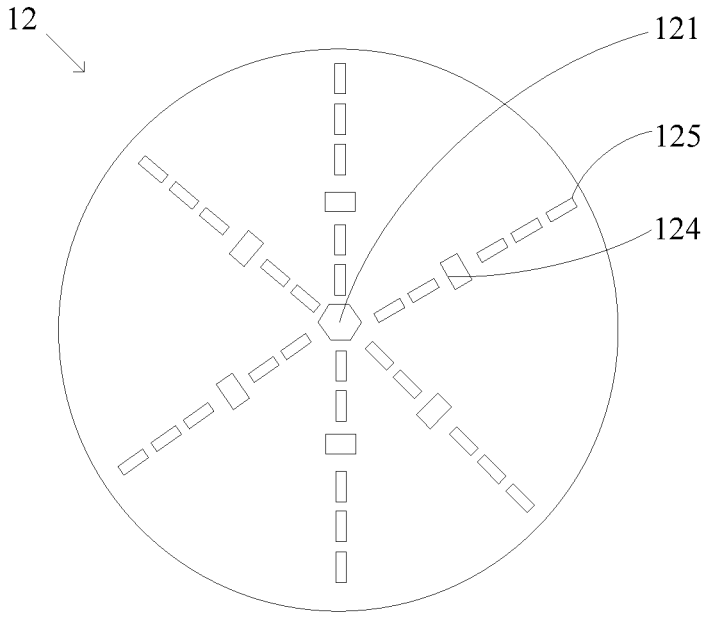
FIG. 3 is a schematic diagram illustrating a structure of an evaporating body according to an exemplary aspect of the present disclosure.

In the evaporating assembly 1, hanging liquid amount of the evaporating body 12 may directly affect evaporation efficiency. To increase the evaporation efficiency of the evaporating assembly 1, an improvement is made to the structure of the evaporating assembly 1 in the present disclosure. The following two illustrative embodiments are further presented:

A plurality of groups of protrusions 125 may be arranged on the evaporating assembly 1. For example, as shown in FIG. 3, the plurality of groups of protrusions 125 may be arranged on the first side surface 122 and the second side surface 123 of the evaporating body 12. The structure of the protrusions 125 may increase the hanging liquid amount of the evaporating body 12 when the evaporating body 12 rotates along with the fixing shaft 11, thereby increasing the evaporation efficiency.

In some embodiment, each group of the above protrusions 125 may be arranged in a radial direction of the mounting hole 121 so that the evaporating body 12 may be liable to carrying the liquid to be evaporated when rotating out of the liquid to be evaporated. Each group of protrusions 125 may be a plurality of strip structures arranged discontinuously, which may increase a falling-back speed of the liquid to be evaporated while increasing the hanging liquid amount, thereby effectively guaranteeing cyclic liquid hanging. Alternatively, each group of protrusions 125 may also be a continuous strip structure. Alternatively, the protrusion 125 may also be a protruding cube, sphere, cylinder or prism and so on. The protrusions 125 are arranged with the purpose of increasing the hanging liquid amount and therefore the specific structure of the protrusions 125 is not limited herein.

In some other embodiments, each group of protrusions 125 may also be distributed at any positions on the evaporating body 12. The protrusions 125 are arranged with the purpose of increasing the hanging liquid amount, and the distribution positions of the protrusions 125 are not limited herein.

It is noted that a height that the limiting portion 124 protrudes out of the evaporating body 12 is taller than a height that the protrusion 125 protrudes out of the evaporating body 12, so that the influence of the arrangement of the structure of protrusions 125 on the abutting mating of different limiting portions 124 of the adjacent evaporating bodies 12 may be avoided, thereby effectively guaranteeing a unified distance of adjacent evaporating bodies 12. The unified distance may help monitor the hanging liquid amount of the evaporating body 12, and thus improve precise control over the evaporation efficiency of the evaporating assembly 1.

Figure 4:
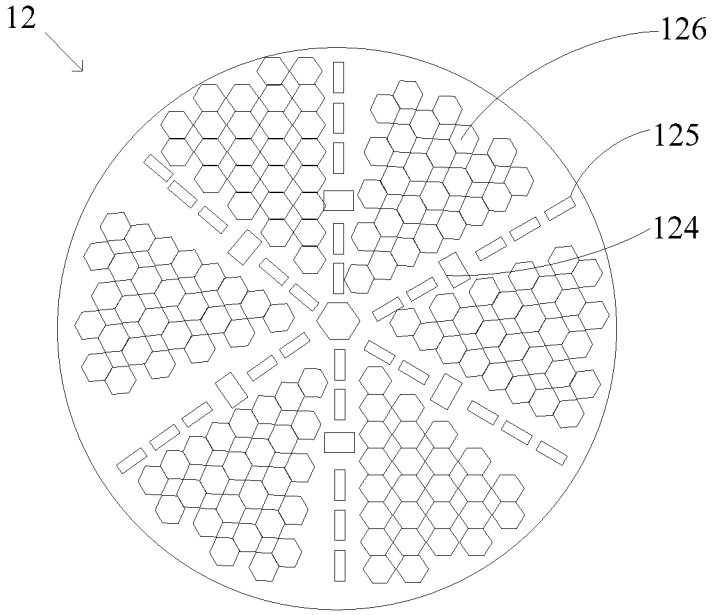
FIG. 4 is a schematic diagram illustrating a structure of an evaporating body according to an exemplary aspect of the present disclosure.

A protruding texture structure 126 may be arranged on the evaporating body 12. For example, as shown in FIG. 4, the protruding texture structure 126 may be arranged on the first side surface 122 and the second side surface 123 of the evaporating body 12. The texture structure 126 may cover the entire first side surface 122 and the entire second side surface 123. With wide distribution of the texture structure 126, the hanging liquid amount of the evaporating body 12 may be effectively increased entirely. Alternatively, the texture structure 126 may also be arranged on a particular region on at least one of the first side surface 122 and the second side surface 123. For example, the texture structure 126 may be arranged in a sector block isolated by the protrusions 125 as shown in FIG. 4. In this way, mutual interference of the texture structure 126 and the protrusions 125 may be effectively avoided, thereby facilitating processing and increasing structural aesthetics.

It is noted that the above texture structure 126 may be of hexagonal structures arranged in an array and may also be of structures of other shapes, which is not limited herein.

The present disclosure further provides a humidifier, including a body and the above evaporating assembly 1. The evaporation efficiency of the humidifier may be effectively improved by using the above evaporating assembly 1, which is also convenient for disassembly, assembly and cleaning.

Other aspects of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as illustrative only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. An evaporating assembly, comprising:

a fixing shaft; and at least two evaporating bodies, each of the evaporating bodies is provided with a mounting hole and at least one group of limiting portions, wherein each of the evaporating bodies is detachably mounted on to the fixing shaft via the mounting hole, and the limiting portions on every two of the evaporating bodies that are adjacent to each other are abuttingly mated so that a first gap is formed between every two of the adjacent evaporating bodies, the mounting hole is a polygonal through hole, the fixing shaft is a prism with a sectional shape corresponding to a shape of the polygonal through hole, the limiting portions include at least one group of abutting ribs, each group of the abutting ribs is arranged uniformly along a circumference concentric to the mounting hole, and a number of sides of the polygonal through hole corresponds to a number of abutting ribs in one group of the abutting ribs.

2. The evaporating assembly according to claim 1, wherein at least one of the evaporating bodies includes a plurality of groups of protrusions that are arranged in a radial direction from the mounting hole on the at least one of the evaporating bodies.

3. The evaporating assembly according to claim 2, wherein, the at least one of the evaporating bodies is in a form of a sheet structure and includes a first side surface and a second side surface that are opposite to each other, and the plurality of groups of protrusions are arranged on at least one of the first side surface and the second side surface.

4. The evaporating assembly according to claim 2, wherein each group of the plurality of groups of protrusions includes a plurality of strip structures arranged discontinuously.

5. The evaporating assembly according to claim 2, wherein a first distance that each of the limiting portions protrudes out of the evaporating body is greater than a second distance that each of the protrusions protrudes out of the evaporating body.

6. The evaporating assembly according to claim 1, wherein at least one of the evaporating bodies includes a protruding texture structure that is arranged on the at least one of the evaporating bodies.

7. The evaporating assembly according to claim 3, wherein the at least one of the evaporating bodies includes a protruding texture structure that is arranged on the at least one of the evaporating bodies.

8. The evaporating assembly according to claim 7, wherein, the plurality of groups of protrusions that are arranged on the first side surface or the second side surface divide the first side surface or the second side surface into a plurality of sector regions, and the protruding texture structure is arranged in at least one of the sector regions.

9. The evaporating assembly according to claim 6, wherein the protruding texture structure includes hexagonal structures arranged in an array.

10. A humidifier, comprising:

a body; and an evaporating assembly including:

a fixing shaft;

a plurality of evaporating bodies mounted on to the fixing shaft, wherein a first gap is formed between every two of the plurality of evaporating bodies that are adjacent to each other; and a mounting hole arranged on each of the plurality of evaporating bodies, wherein each of the plurality of evaporating bodies is detachably mounted on to the fixing shaft through the mounting hole, wherein each of the evaporating bodies is provided with at least one group of limiting portions, and the limiting portions on every two of the evaporating bodies that are adjacent to each other are abuttingly mated so that the first gap is formed between every two of the adjacent evaporating bodies, the mounting hole is a polygonal through hole, the fixing shaft is a prism with a sectional shape corresponding to a shape of the polygonal through hole, the limiting portions include at least one group of abutting ribs, each group of the abutting ribs is arranged uniformly along a circumference concentric to the mounting hole, and a number of sides of the polygonal through hole corresponds to a number of abutting ribs in one group of the abutting ribs.

11. An evaporating assembly, comprising:

a fixing shaft; and at least two evaporating bodies, each of the evaporating bodies is provided with a mounting hole and at least one group of limiting portions, wherein each of the evaporating bodies is detachably mounted on to the fixing shaft via the mounting hole, and the limiting portions on every two of the evaporating bodies that are adjacent to each other are abuttingly mated so that a first gap is formed between every two of the adjacent evaporating bodies, and at least one of the evaporating bodies includes a plurality of groups of protrusions that are arranged in a radial direction from the mounting hole on the at least one of the evaporating bodies.

* * * * *